US010651608B2

(12) United States Patent
White

(10) Patent No.: US 10,651,608 B2
(45) Date of Patent: May 12, 2020

(54) CONNECTOR ASSEMBLY WITH GROUNDING CLAMP SYSTEM

(71) Applicant: COMMSCOPE TECHNOLOGIES LLC, Hickory, NC (US)

(72) Inventor: Gordon John White, Gloucester (GB)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/316,262

(22) PCT Filed: Jul. 6, 2017

(86) PCT No.: PCT/US2017/040947
§ 371 (c)(1),
(2) Date: Jan. 8, 2019

(87) PCT Pub. No.: WO2018/009698
PCT Pub. Date: Jan. 11, 2018

(65) Prior Publication Data
US 2019/0252831 A1 Aug. 15, 2019

Related U.S. Application Data

(60) Provisional application No. 62/359,884, filed on Jul. 8, 2016.

(51) Int. Cl.
*H01R 24/00* (2011.01)
*H01R 13/6592* (2011.01)
(Continued)

(52) U.S. Cl.
CPC ..... *H01R 13/6592* (2013.01); *H01R 9/037* (2013.01); *H01R 13/5837* (2013.01); *H01R 24/64* (2013.01); *H01R 2107/00* (2013.01)

(58) Field of Classification Search
CPC ... H01R 23/025; H01R 13/506; H01R 23/005
(Continued)

(56) References Cited

U.S. PATENT DOCUMENTS 3,739,076 A 6/1973 Schwartz
3,830,957 A 8/1974 Oberdiear
(Continued)

FOREIGN PATENT DOCUMENTS

DE 101 13 230 A1 9/2002
EP 0 073 112 A1 3/1983
(Continued)

OTHER PUBLICATIONS

International Search Report and Written Opinion of the International Searching Authority for International Patent Application No. PCT/US2017/040947, dated Oct. 13, 2017, 11 pages.

*Primary Examiner* — Phuong Chi Thi Nguyen
(74) *Attorney, Agent, or Firm* — Merchant & Gould P.C.

(57) ABSTRACT

A connector assembly (10) is disclosed in which a connector part (12) and a cable manager part (20) are provided. The cable manager part (20) can be provided with a housing assembly (70, 170, 270, 370) that contains a pair of clamp members (74, 174, 274, 374) that function together to ensure a grounded connection between the connector assembly (10) and a conductive element (5) of a cable (4).

15 Claims, 16 Drawing Sheets

(51) Int. Cl.

| | |
|---|---|
| ***H01R 13/58*** | (2006.01) |
| ***H01R 9/03*** | (2006.01) |
| *H01R 24/64* | (2011.01) |
| *H01R 107/00* | (2006.01) |

(58) Field of Classification Search
USPC ..... 439/676, 686, 941
See application file for complete search history.

(56) References Cited

U.S. PATENT DOCUMENTS

| | | | |
|---|---|---|---|
| 4,537,458 | A | 8/1985 | Worth |
| 4,747,785 | A | 5/1988 | Roberts et al. |
| 4,790,765 | A | 12/1988 | Ehrenfels et al. |
| 4,810,210 | A | 3/1989 | Komatsu |
| 4,824,400 | A | 4/1989 | Spinner |
| 4,830,628 | A | 5/1989 | Dyson et al. |
| 4,842,553 | A | 6/1989 | Ingram |
| 4,857,015 | A | 8/1989 | Michaels et al. |
| 5,278,352 | A | 1/1994 | Schade |
| 5,310,359 | A | 5/1994 | Chadbourne et al. |
| 5,445,538 | A | 8/1995 | Rodrigues et al. |
| 5,691,506 | A | 11/1997 | Miyazaki et al. |
| 5,697,806 | A | 12/1997 | Whiteman, Jr. et al. |
| 6,077,122 | A | 6/2000 | Elkhatib et al. |
| 6,254,403 | B1 | 7/2001 | Bernardini |
| 6,354,851 | B1 | 3/2002 | Bachle |
| 6,386,915 | B1 | 5/2002 | Nelson |
| 6,520,781 | B2 | 2/2003 | Koide et al. |
| 6,537,104 | B1 | 3/2003 | Hagmann et al. |
| 7,156,696 | B1 | 1/2007 | Montena |
| 7,416,448 | B2 | 8/2008 | Gaidosch |
| 7,637,769 | B2 | 12/2009 | Carreras Garcia et al. |
| 7,727,013 | B1 | 6/2010 | Paynter |
| 7,766,688 | B2 | 8/2010 | Mateo Ferrus et al. |
| 7,819,698 | B2 | 10/2010 | Islam |
| 7,871,285 | B1 | 1/2011 | Tobey et al. |
| 7,874,865 | B2 | 1/2011 | Tobey |
| 8,454,383 | B2 | 6/2013 | Paynter et al. |
| 8,747,126 | B2 | 6/2014 | Corbett et al. |
| 9,022,792 | B2 | 5/2015 | Sticker et al. |
| 9,583,885 | B2 | 2/2017 | Ruesca Fernandez |
| 2004/0038582 | A1 | 2/2004 | Clement |
| 2008/0102686 | A1 | 5/2008 | Carreras Garcia et al. |
| 2008/0268719 | A1 | 10/2008 | Siemon et al. |
| 2009/0311904 | A1 | 12/2009 | Chen |
| 2011/0304343 | A1 | 12/2011 | Font Aranega et al. |
| 2012/0244736 | A1 | 9/2012 | Duran et al. |
| 2013/0203291 | A1 | 8/2013 | Sticker et al. |
| 2014/0242855 | A1 | 8/2014 | Kan et al. |
| 2014/0287609 | A1* | 9/2014 | Fransen ..... H01R 4/2445 439/345 |
| 2015/0349468 | A1 | 12/2015 | Singer et al. |
| 2016/0285205 | A1 | 9/2016 | Ruesca Fernandez |

FOREIGN PATENT DOCUMENTS

| | | | |
|---|---|---|---|
| EP | 0 775 845 | A2 | 5/1997 |
| EP | 1 484 824 | A2 | 12/2004 |
| EP | 2 133 957 | A1 | 12/2009 |
| ES | 2 178 813 | T3 | 1/2003 |
| ES | 1 138 538 | U | 4/2015 |
| ES | 2 583 636 | A1 | 9/2016 |
| ES | 2 584 539 | A1 | 9/2016 |
| ES | 2 600 968 | A1 | 2/2017 |
| GB | 221 872 | | 9/1924 |
| GB | 2 260 660 | A | 4/1993 |
| JP | 2007-299620 | A | 11/2007 |
| KR | 20-2010-0008888 | U | 9/2010 |
| WO | 95/34923 | A1 | 12/1995 |
| WO | 03/026076 | A1 | 3/2003 |
| WO | 2005/104300 | A1 | 11/2005 |
| WO | 2008/095830 | A1 | 8/2008 |
| WO | 2016/156644 | A1 | 10/2016 |

* cited by examiner

CONNECTOR ASSEMBLY WITH GROUNDING CLAMP SYSTEM

CROSS-REFERENCE TO RELATED APPLICATION

This application is a National Stage Application of PCT/US2017/040947, filed on Jul. 6, 2017, which claims the benefit of U.S. Patent Application Ser. No. 62/359,884, filed on Jul. 8, 2016, the disclosures of which are incorporated herein by reference in their entireties. To the extent appropriate, a claim of priority is made to each of the above disclosed applications.

BACKGROUND

Electrical connectors are useful for providing a connection point for telecommunications systems. For example, RJ-type connectors can be provided as wall sockets wherein electronic data cables are terminated and mating electrical plugs can be inserted into the sockets. Frequently, this termination process occurs in the field and at the actual location where the cables to be attached to the connectors are being installed. In such instances, it is often necessary to provide a grounding connection between the cable and its attached connector.

SUMMARY

A connector assembly is disclosed. Connector assemblies including grounding clamps are disclosed. The disclosed connector assemblies provide for a compact cable clamp/shield connection method that can accommodate a large range of cable sizes. For example, the disclosed clamp can accommodate cables ranging from 4.6 to 9.0 mm. Another feature of the disclosed clamps is that all parts of the clamping features are inboard of the sides of the connector assembly or jack such that no protrusions exist. As the connector assemblies or jacks are to be used in high density applications, where in some cases they are mounted side by side and or back to back, any protrusions from a clamp outside the connector assembly bodies would prevent this configuration.

In one aspect, the connector assembly includes a connector part having a jack cavity and a cable manager part. The cable manager part can be configured to be installed within the connector part to form the connector assembly. The cable manager part may include a housing assembly having a central aperture through which a cable having an exposed conductive element, such as a metal shield or sheath, can extend. The connector assembly may also include a grounding clamp assembly held within the housing assembly.

In one embodiment, the connector assembly can include a connector part having a jack cavity and a cable manager part. The cable manager part is conductively attached to the connector part. The cable manager part includes a housing assembly having a housing part defining a central aperture through which a cable having an exposed conductive element can extend. A grounding clamp assembly is held within the housing part, the grounding clamp assembly including a first clamp member and an oppositely arranged second clamp member, the first and second clamp members being movable between an open position and a clamped position. In the open position, the clamp members are disposed away from the central aperture and are in a relaxed, non-deflected state. In the clamped position, the clamp members extend across the central aperture and contact the conductive element of an inserted cable by one or both of bending around the conductive element in a deflected state and rotating against the conductive element.

BRIEF DESCRIPTION OF THE DRAWINGS

Non-limiting and non-exhaustive embodiments are described with reference to the following figures, which are not necessarily drawn to scale, wherein like reference numerals refer to like parts throughout the various views unless otherwise specified.

DETAILED DESCRIPTION

Figure 1:
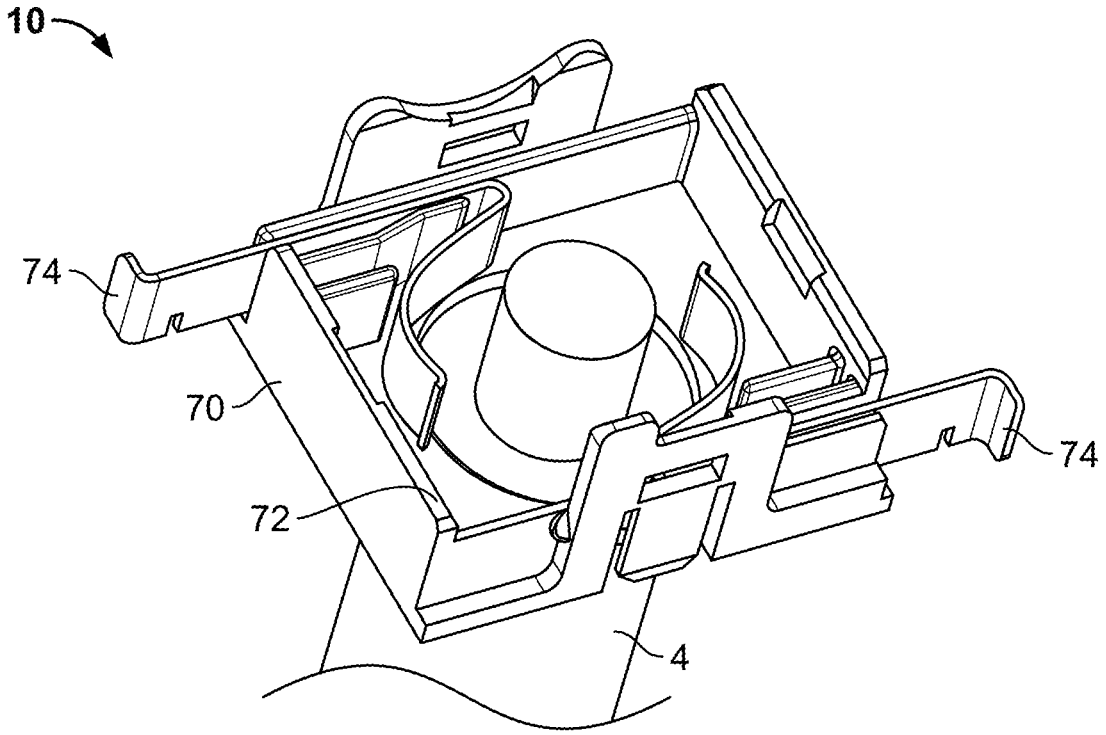
FIG. 1 is a perspective view of a main body of a telecommunications connector cable manager part having features that are examples of aspects in accordance with the principles of the present disclosure, wherein a cable is received within the main body.
Figure 2:
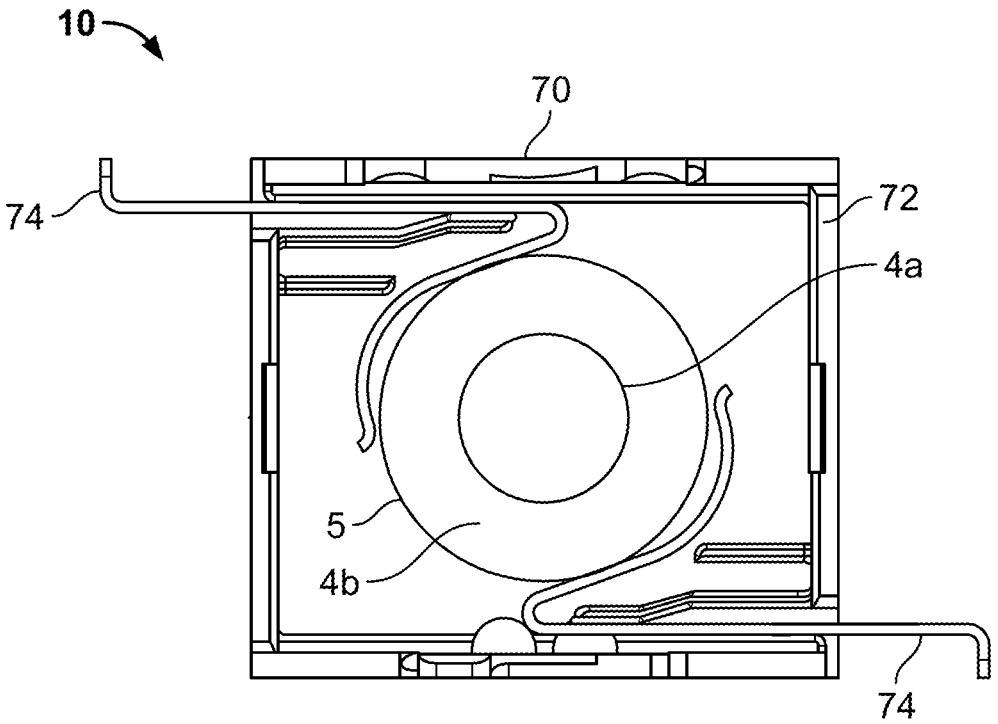
FIG. 2 is a top view of the cable manager part main body shown in FIG. 1.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Figure 3:
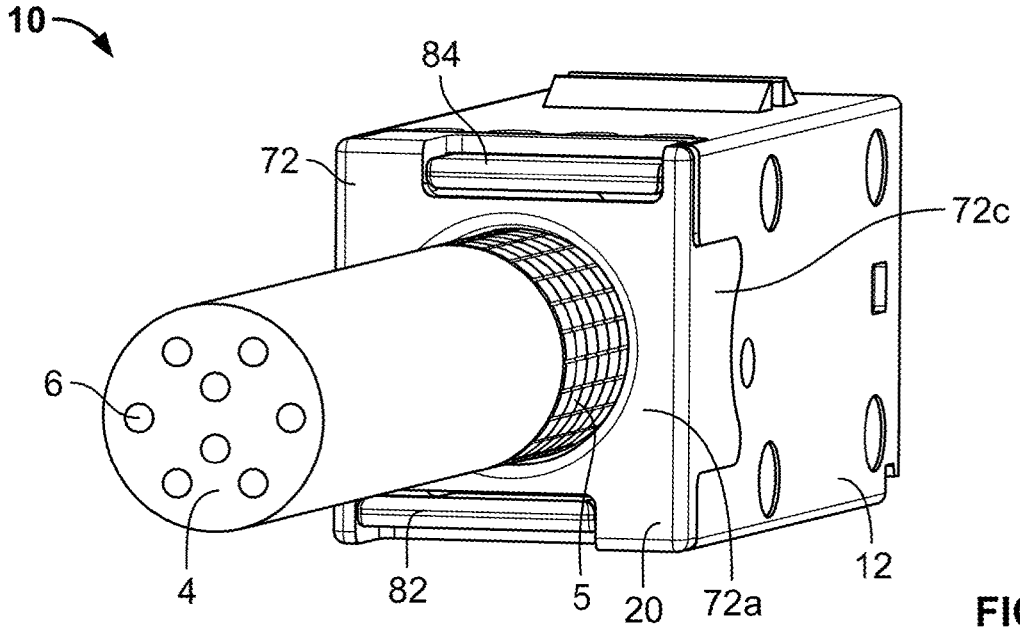
FIG. 3 is a perspective view of a cable connected to a telecommunications connector having the connector part and a cable manager part having features that are examples of aspects in accordance with the principles of the present disclosure.
Figure 4:
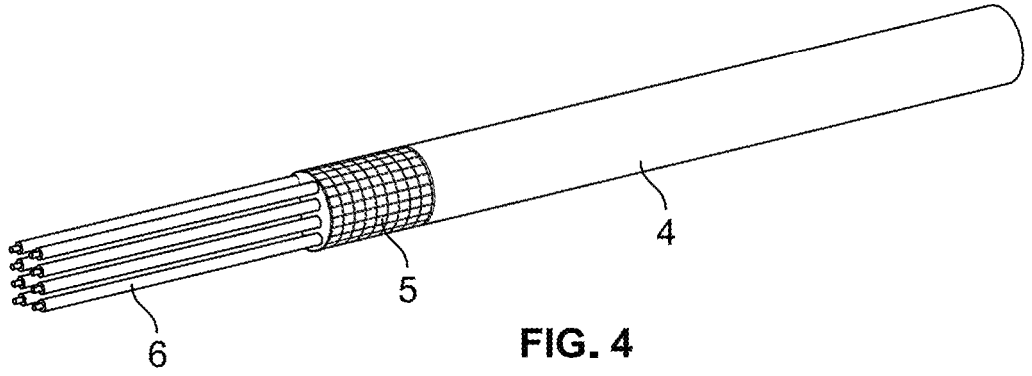
FIG. 4 is a perspective view of the cable shown in FIGS. 1 and 3, removed from the telecommunications connector.
Figure 5:
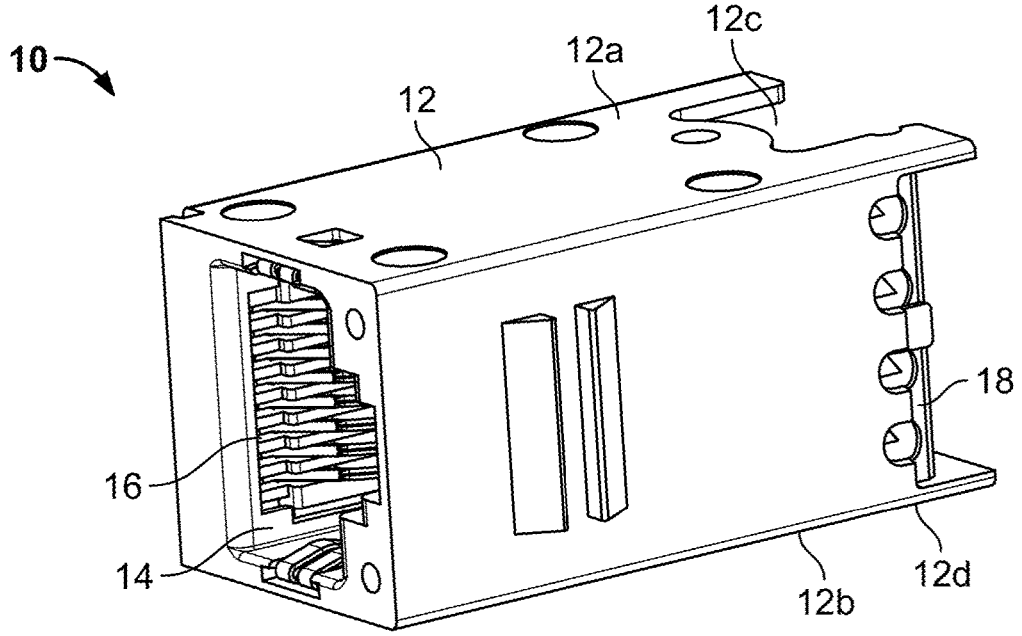
FIG. 5 is a perspective view of a connector part usable with the cable manager part and cable shown in FIG. 1.
Figure 6:
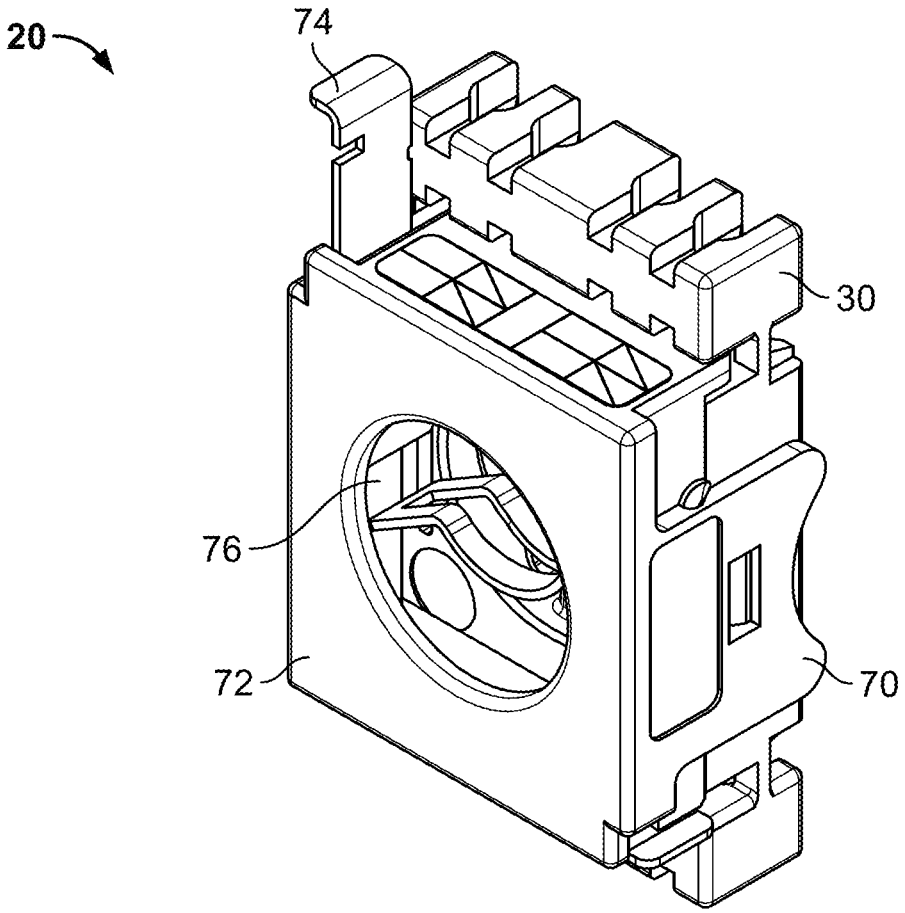
FIG. 6 is a perspective view of the cable manager part shown in FIG. 1, with a lacing fixture shown as being attached to a housing assembly.
Figure 7:
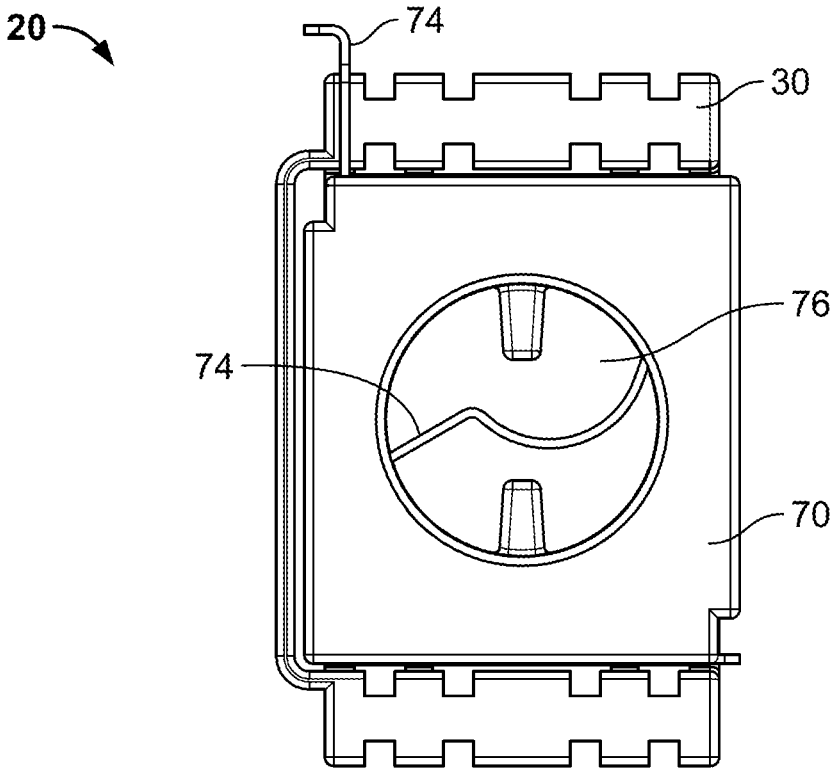
FIG. 7 is a front view of the cable manager part shown in FIG. 6.

A telecommunications connector 10 for grounded connection with a cable 4 having a conductive element 5 and a plurality of wires 6 is shown. One example of a suitable cable 4 is shown at FIG. 3. As used herein, term "conductive element" is defined as including any type of conductive element, shield, or sheath disposed over the cable jacket, including metal braids, meshes, foils, drain wires, and combinations thereof. In one example, the cable 4 includes a plurality of insulated copper wires 6, for example, four sets of twisted wire pairs, while the connectors 10 are modular or RJ-type connectors. As shown, the telecommunications connector 10 has a connector part 12 which includes a jack cavity 14 for receiving a corresponding plug (not shown). As most easily seen at FIG. 4, the connector part 12 can include a plurality of electrical contact members 16 for which electrical connection to the wires 6 will be made through a termination and connection process. The connector part 12 is further provided with a pair of cutting edges 18 which are designed to cut the wires 6 of the cable 4 during the termination process. As shown, the connector part 12 has conductive sidewalls 12*a*, 12*b* which are formed from a conductive material, such as a metal material. In one aspect, the sidewalls 12*a*, 12*b* each define a respective recess portion 12*c*, 12*d*. The recess portions 12*c*, 12*d* receive and connect to the housing assembly 70 first and second sides (e.g. 72*b*, 72*c*) respectively, such that conductive contact is established between the housing assembly 70 and the sidewalls 12*a*, 12*b* of the connector 10. Accordingly, the connector 10 is grounded to the cable conductive element 5 via the housing assembly 70 and the sidewalls 12*a*, 12*b*. One example of a suitable termination process and connector part is shown and described in Spain patent application P201530417, entitled Connector Assembly with Grounding Spring and filed on 27 Mar. 2015, the entirety of which is incorporated by reference herein. Another example of a suitable termination process and connector part is shown and described in Spain patent application P201531199, entitled Connector Assembly with Grounding Spring Clamp and filed on 13 Aug. 2015, the entirety of which is incorporated by reference herein.

The connector part 12 and the cable manager part 20 used in the various embodiments may be configured in a complementary manner, so that the connector part 12 is able to engage with the cable manager part 20 only in one orientation. The cable manager part 20 can be further provided with a main body for facilitating connection between the conductors in the wires 6 and the contact members 16. The cable manager part 20 can also include a lacing structure 30 to place the wires 6 in the appropriate orientation for termination. An example lacing structure 30 suitable for use with the cable manager part 20 disclosed herein can be found in Spain patent application P201530372 entitled Connector with Separable Lacing Fixture and filed on 20 Mar. 2015, the entirety of which is incorporated by reference herein.

Figure 8:
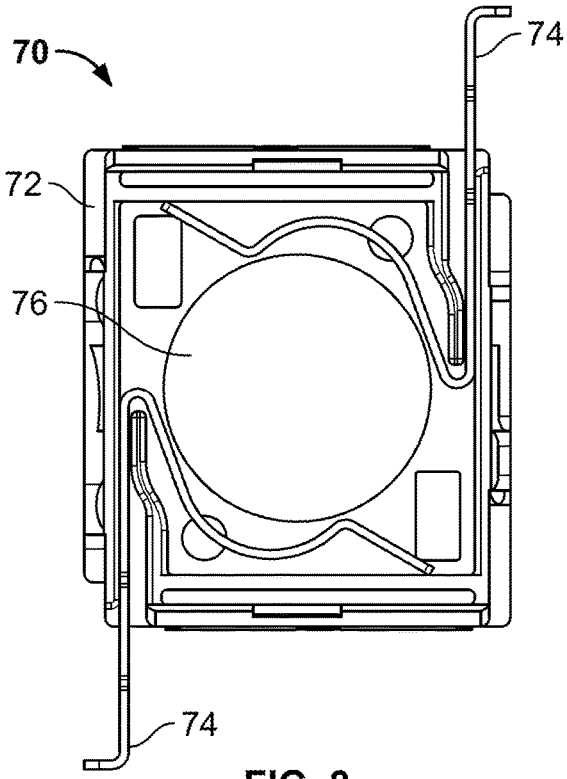
FIG. 8 is a front view of the housing assembly shown in FIG. 6.
Figure 9:
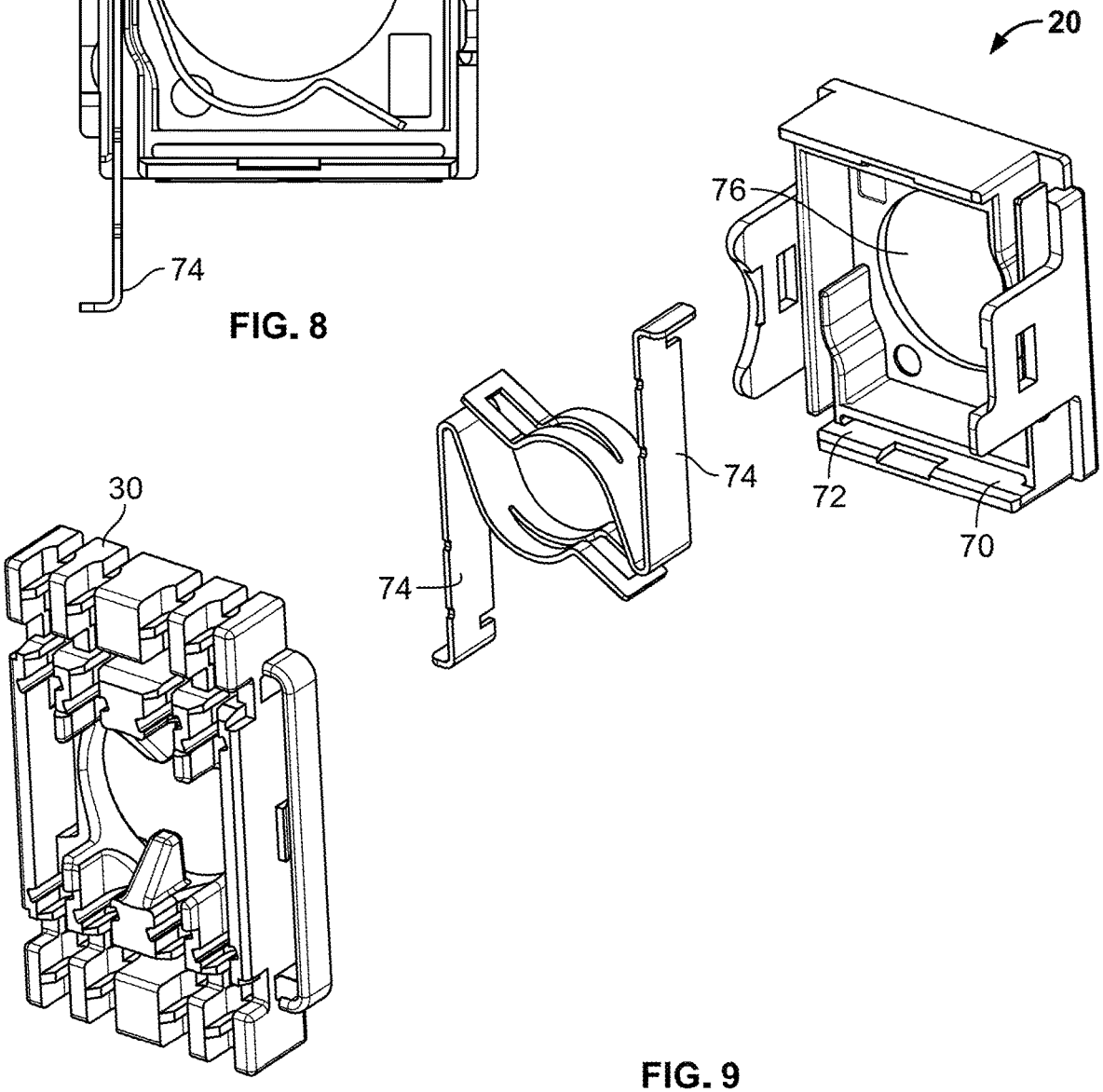
FIG. 9 is an exploded perspective view of the cable manager part shown in FIG. 9.
Figure 10:
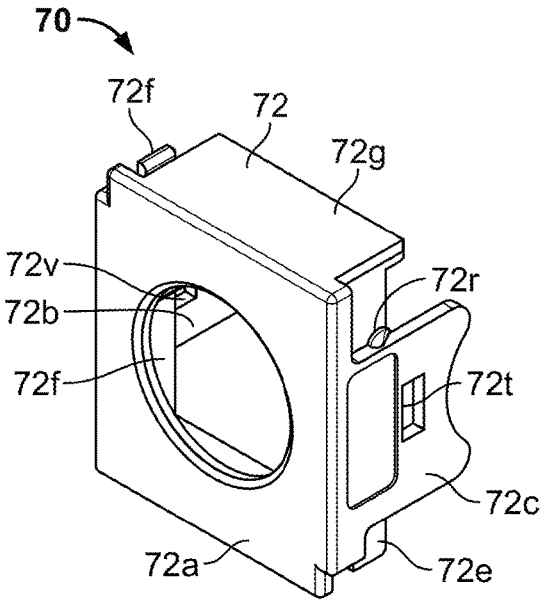
FIG. 10 is a perspective view of a main body of the housing assembly shown in FIG. 6.
Figure 11:
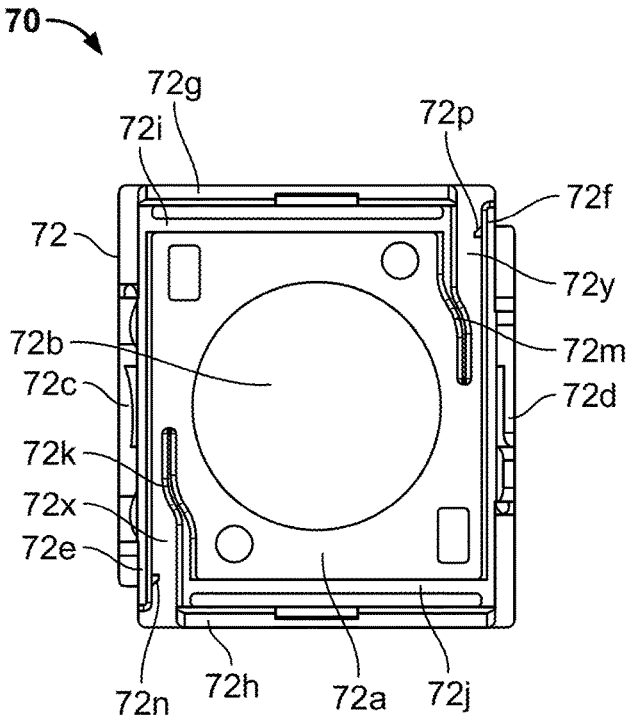
FIG. 11 is a front view of the main body shown in FIG. 10.
Figure 12:
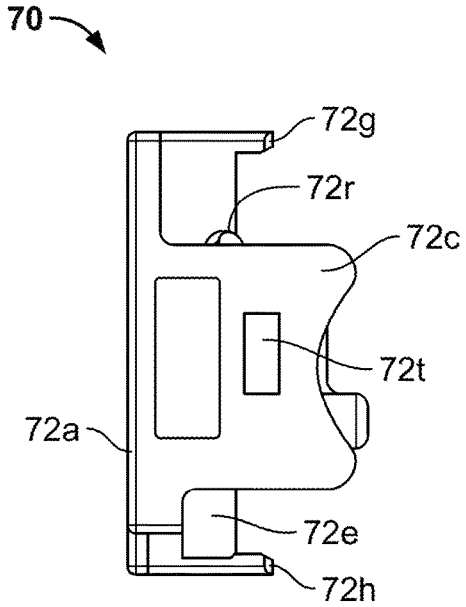
FIG. 12 is a first side view of the main body shown in FIG. 10.
Figure 13:
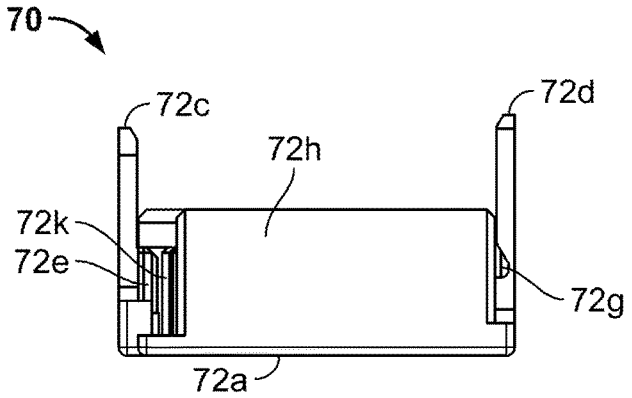
FIG. 13 is a second side view of the main body shown in FIG. 10.
Figure 14:
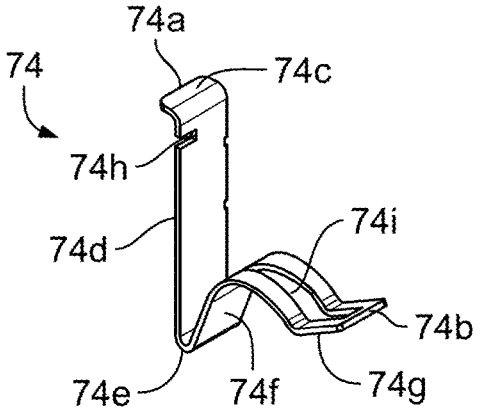
FIG. 14 is a front perspective view of a clamp member of the housing assembly shown in FIG. 6.
Figure 15:
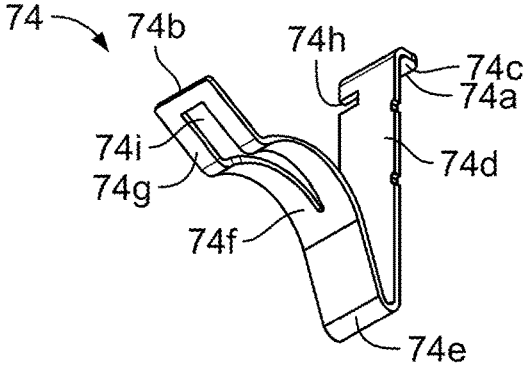
FIG. 15 is a rear perspective view of the clamp member shown in FIG. 14.
Figure 16:
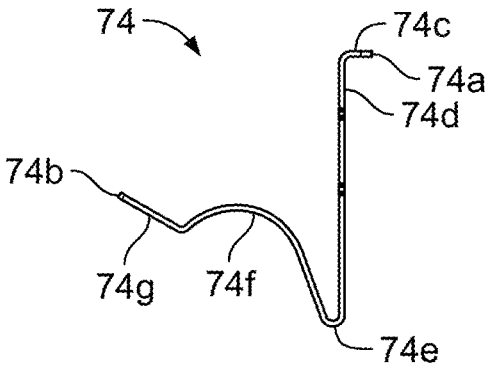
FIG. 16 is a side view of the clamp member shown in FIG. 14.
Figure 17:
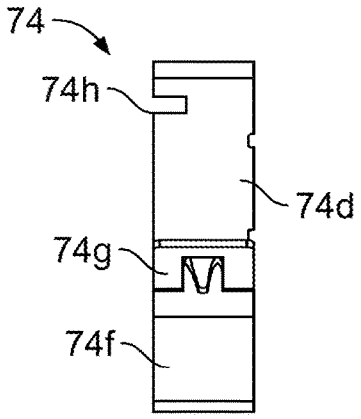
FIG. 17 is a front view of the clamp member shown in FIG. 14.
Figure 18:
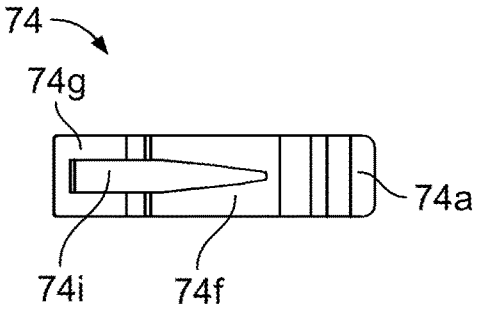
FIG. 18 is a top view of the clamp member shown in FIG. 14.
Figure 19:
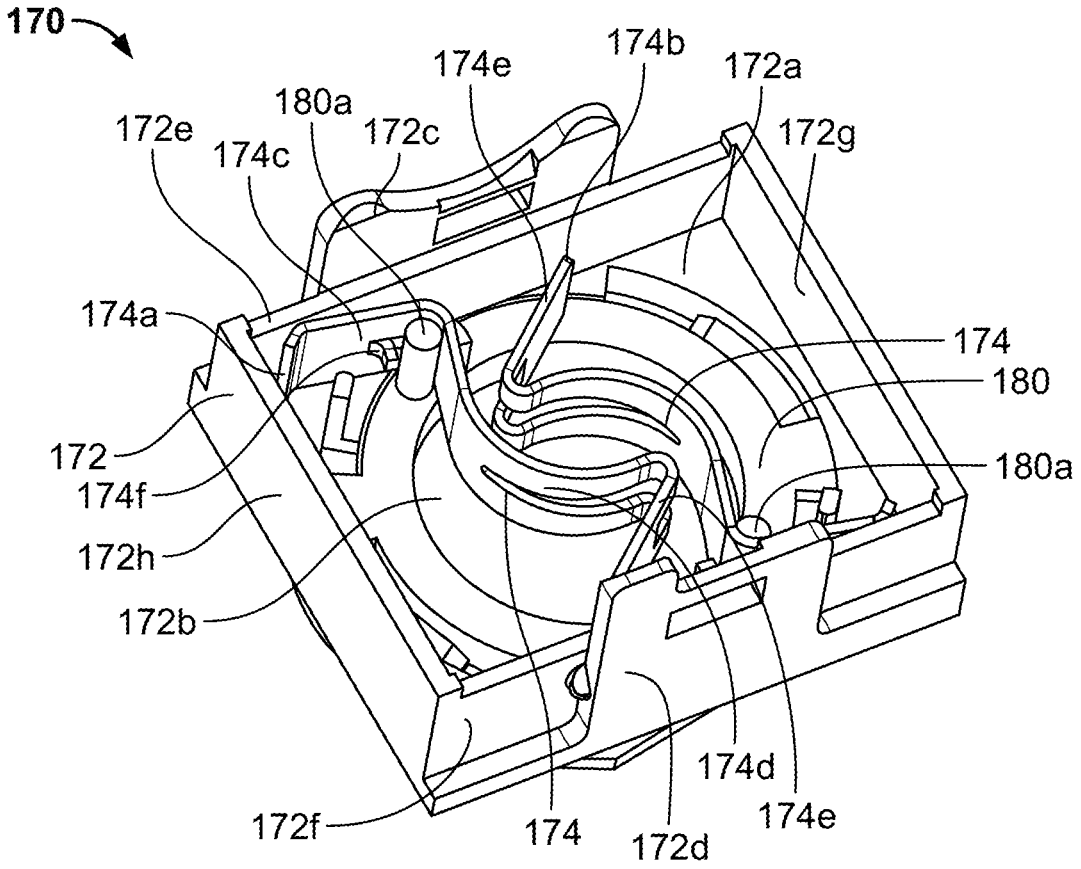
FIG. 19 is a perspective view of a second embodiment of a cable manager part for use with the connector part of FIG. 4 having features that are examples of aspects in accordance with the principles of the present disclosure.

Referring to FIGS. 1-2 and 6-18 a first embodiment of a connector assembly 10 having a cable manager part 20 with a housing assembly 70 and lacing fixture 30 is illustrated. The housing assembly 70 is shown in isolation from the remainder of the connector assembly 10 at FIGS. 1-2 and 8. In one aspect, the housing assembly 70 includes a main body 72 that receives a pair of clamp members 74. Taken together, the clamp members 74 form a grounding clamp assembly that enable grounding contact with the cable sheath 5. Of note, FIGS. 2, 20, 21, 27 and 36 shows two differently sized cables 4*a*, 4*b* that can be accommodated by the grounding clamp assembly, wherein the cable 4*a* has a diameter of about 4.6 millimeters and the cable 4*b* has a diameter of about 9.0 millimeters. This range in cable sizes that can be accommodated is due to the elastic nature and/or the rotatable movement of the clamp members. The grounding clamp assembly can be configured to accommodate other ranges of cable sizes without departing from the concepts presented herein.

The housing assembly 70 is shown as having a main body 72 with an end wall 72*a* within which a central aperture 72*b* is defined. In one aspect, a plurality of sidewalls are provided that extend from the end wall 72*a*. For example, and as most easily seen at FIGS. 10-13, sidewalls 72*c* to 72*m* can be provided. Sidewalls 72*e*, 72*f*, 72*g*, and 72*h* generally form an outer perimeter sidewall structure while sidewalls 72*c*, 72*d* are configured to be received within correspondingly shaped recesses of the connector 12. Interior sidewalls 72*m*, 72*k* are configured to provide a support structure for the lacing fixture 30. Interior sidewalls 72*k*, 72*m* are provided in an offset relationship with sidewalls 72*e*, 72*f* to form a channel 72*x*, 72*y* within which the clamp members 74 can be received and guided.

The main body 72 also includes a latch members 72*n*, 72*p* respectively protruding from end walls 72*e*, 72*f*. The latch members 72*n*, 72*b* are each for engaging a clamp member 74 which is received into a channel 72*x*, 72*y* respectively defined between sidewalls 72*e*/72*k* and 72*f*/72*m*. This engagement ensures that the clamp members 74 are held securely in the clamped position such that full engagement between the clamp members 74 and the sheath 5 is attained at all times. The main body 72 additionally includes protrusions 72*r*, 72*s* and apertures 72*t*, 72*v* for enabling a snap-fit type engagement between the housing part main body 72 and the connector 12.

The clamp member 74 is shown in isolation from the remainder of the housing assembly 10 at FIGS. 12-16. The housing assembly 10 includes two clamp members 74 that cooperate with each other to provide a clamping function against the cable sheath 5 once a cable is inserted into the aperture 72*b* of the housing part main body 72. As shown, the clamp member 74 extends continuously between a first end 74*a* and a second end 74*b* and can be defined as having a handle portion 74*c*, a slide portion 74*d*, bend portion 74*e*, a clamping portion 74*f*, and an end portion 74*g*. A notch 74*h* is provided in the slide portion 74*d* which engages with the latch portions 74*f*/74*n* to hold the clamp member in a clamped position once the clamp member slide portion 74*d* has been fully inserted into the channel 74*x*/74*y*. The handle portion 74*c* acts as a stop member against the end of the sidewall 74*e*/74*f* once full insertion has been achieved and also acts as a grasping element for an operator for pulling the clamp member away from the housing part main body 72. The clamp member 74 is also provided with an aperture 74*i* which extends through the clamp portion 74*f* and the end portion 74*g*. The aperture 74*i* enhances the flexibility of the clamp portion 74*f* of the clamp member 74 such that the clamp portion 74*f* can more easily conform around variously sized cables 6.

In operation, the clamp members 74 are slidably engaged within the main body 72 and can slide between a clamped position and an open position along axes that are parallel with the slide portions 74*d*. In the clamped position, the clamp members handle portions 74*c* are pressed towards the main body 72 such that the clamping portions 72*f* extend into the central aperture area 72*b* and engage against the cable sheath 5 of the cable 4. As mentioned above, in the fully clamped position, the notches 74*h* of the clamp members are engaged with the latches 72*n*, 72*p* such that the clamp members 74 remain in the clamped position until released by an operator. To move the clamp members 74 into the open position, the clamp member handle portions 74*c* are first deflected towards each other (i.e. towards aperture 72*b*) to disengage the slid portion notches 74*h* from the latches 72*n*, 72*p* and are then pulled away from the main body 72 in a direction parallel to the slide portion 74*d*, such that the clamping portions 72*f* are outside of the central aperture area 72*b*. The open position can be viewed at FIGS. 1 and 8.

Other embodiments for a housing assembly for a connector assembly are also disclosed herein. For example, a second embodiment of a housing assembly 170 is presented at FIGS. 19-25, a third embodiment of a housing assembly 270 is presented at FIGS. 26-34, and a fourth embodiment of a housing assembly 370 is presented at FIGS. 37-42. As many of the concepts and features of the second, third, and fourth embodiments 170, 270, 370 are similar to the first embodiment shown in FIGS. 1-2 and 6-18, the description for the first embodiment is applicable to and incorporated by reference herein for the second, third, and fourth embodiments. Where like or similar features or elements are shown, the same reference numbers will be used where possible (e.g. reference number 170/270/370 instead of reference number 70 for the housing assembly). The following description for the second, third, and fourth embodiments 170, 270, 370 will be limited primarily to the differences between these embodiments and the previously described first embodiment.

As shown, the second embodiment of the housing assembly 170 shown at FIGS. 19-25 includes a housing main body 172 having a front face 172*a* within which a central aperture 172*b* is defined. Sidewalls 172*e*, 172*f*, 172*g*, 172*h* extend from the front face 172*a* to define a perimeter area while sidewalls 172*c*, 172*d* are provided to enable a snap-fit connection with the connector 12. A pair of clamp members 174 is also provided. Each of the clamp members 174 extends between first and second ends 174*a*, 174*b* between which first, second, and third portions 174*c*, 174*d*, 174*e* separated by bends are defined. The clamp members 174 are disposed between the sidewalls 172*e*, 172*f*, 172*g*, 172*h* such that the first end 174*a* and first portion 174*c* are held against sidewall 172*e* or 172*f*. The clamp members 174 are moved between clamped and open positions by a ring member 180 that is rotatably engaged with the housing part 172 and surrounds the central aperture 172*b*. The ring member 180 includes pins 180*a* that engage with the clamp members 174 at the bend location between the first and second portions 174*c*, 174*d* . Each of the clamp members 174 may include a tab portion 174*f* that can engage against the pin 180*a* to secure the clamp member 174 to the ring member 180. A backing portion 180*b* may also be provided on the ring member 180 to ensure the clamp member 174 remains engaged against the pin 180*a*.

Figure 20:
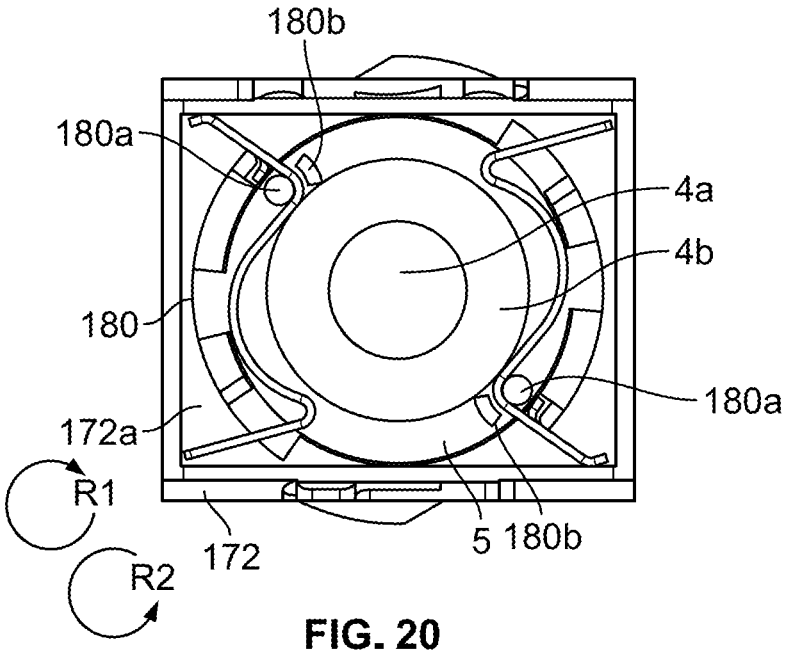
FIG. 20 is a top view of the connector part shown in FIG. 19, with a cable 6 inserted, wherein the connector part is in an unclamped state.

As can be seen at FIG. 20, the ring member 180 is rotated into a position such that the clamp members 174 are in the open position. In this position, the second ends 174*b* of the clamp members 174 are proximate the sidewalls 172*g*, 172*h* and the clamp members 174 are outside of the area defined by the central aperture 172*b*. From this position, the ring member 180 can be rotated in a direction R1 which causes the pins 180*a* to drive the clamp members 174 towards each other and into the area defined by the central aperture 17*b*2. This motion of the ring member 180 causes that the clamp member second ends 174*b* to be driven towards the central aperture 172*b* and away from the sidewalls 172*g*, 172*h*. Consequently, the second portions 174*d* of the clamp members 174 are forcibly engaged against the cable sheath 5.

Figure 21:
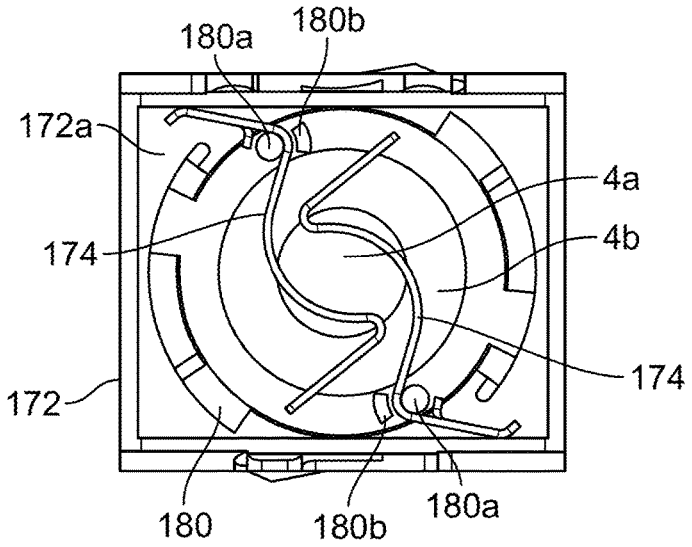
FIG. 21 is a top view of the connector part shown in FIG. 19, with a cable 6 inserted, wherein the connector part is in a clamped state.
Figure 22:
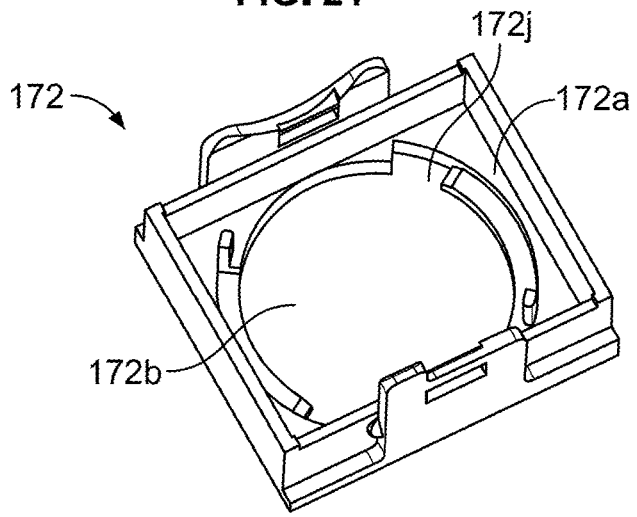
FIG. 22 is a top perspective view of a main body of the connector part shown in FIG. 19.
Figure 23:
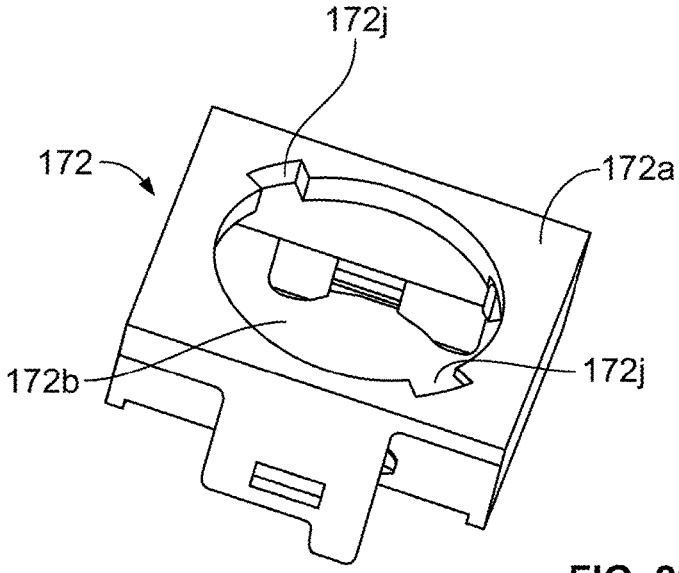
FIG. 23 is a bottom perspective view of the main body shown in FIG. 22.
Figure 24:
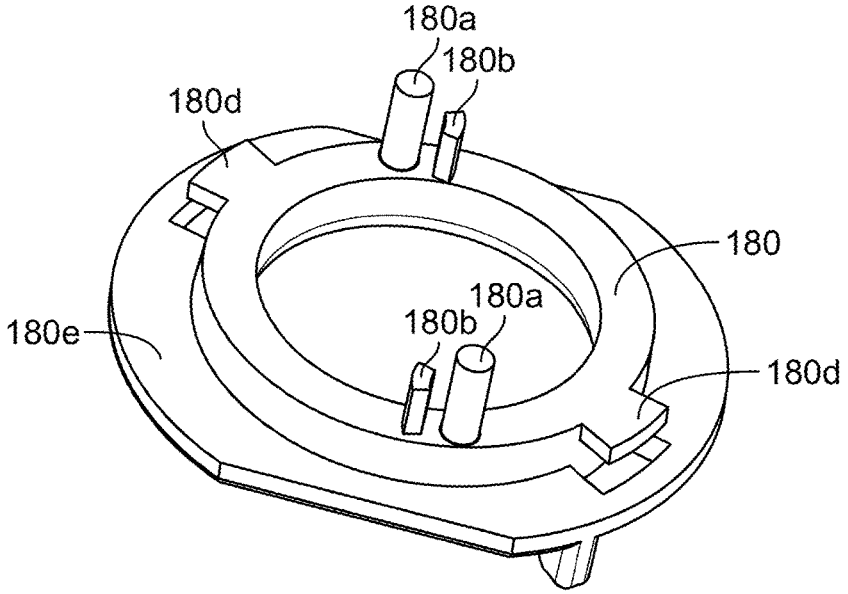
FIG. 24 is a top perspective view of a rotational clamp member of the connector part shown in FIG. 19.
Figure 25:
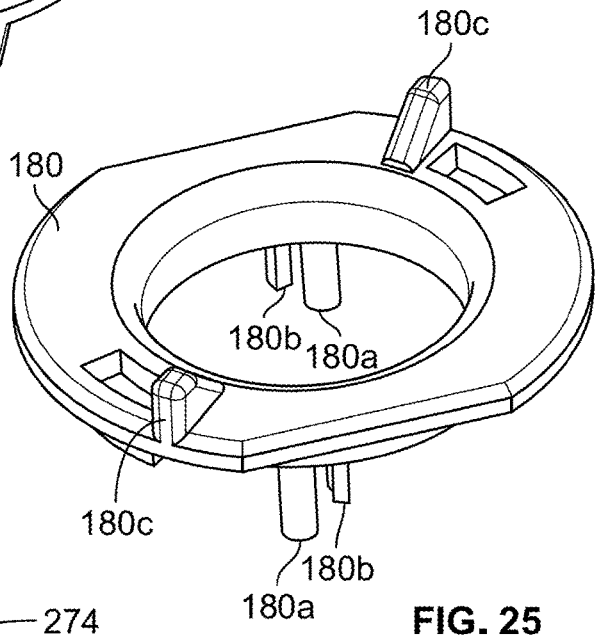
FIG. 25 is a bottom perspective view of the rotational clamp member shown in FIG. 24.
Figure 26:
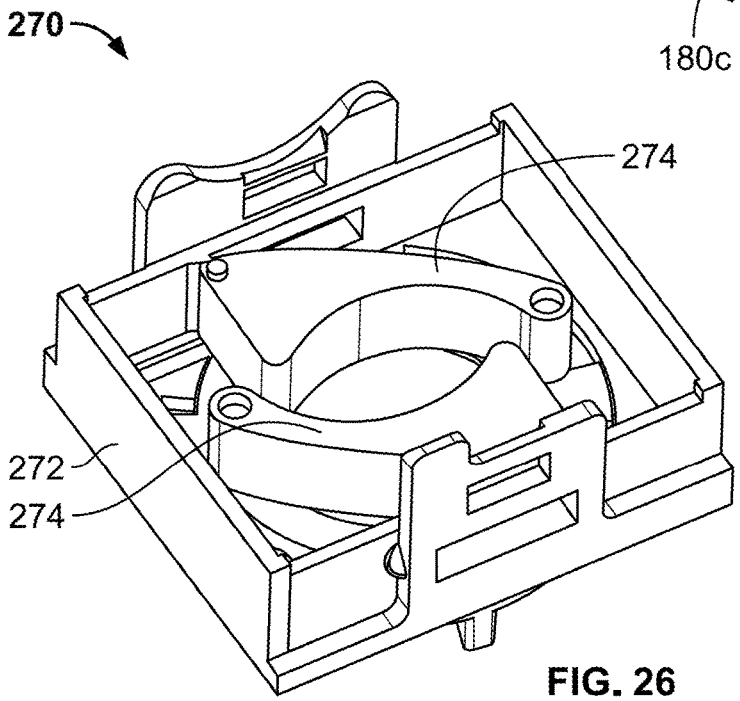
FIG. 26 is a top perspective view of a third embodiment of a cable manager part for use with the connector part of FIG. 5 having features that are examples of aspects in accordance with the principles of the present disclosure.

FIG. 21 shows the clamp members 174 in the clamped position, but does not show the resulting deflection of the clamp members 174 that would naturally occur with a cable 4 present within the central aperture 172*b*. When a cable 4 is present, the clamp members 174 will deflect about the pins 180*a* and along the second portions 174*d*. To move the clamp members 174 back to the open position, the ring member 180 can be rotated in a direction R2 which is opposite the first direction R1. To aid a user in manipulating rotation of the ring member 180, handles 180*b* may be provided. To secure the ring member 180 to the first housing part 172, the ring member 180 may be provided with a main surface 180*e* and offset tab portions 180*d* between which the front wall 172*a* is disposed. The front wall 172*a* may be provided with notches 172*j* to initially receive the tab portions 180*d* when initially inserting the ring member 180 into the housing part 172. Once the ring member 180 is rotated from this initial position, the main surface 180*e* and tab portions 180*d* sandwich the front wall 182*a* to rotatably secure the ring member 180 with respect to the housing part 172.

Referring to the third embodiment of a housing assembly 270 presented at FIGS. 26-34, it is noted that this embodiment is similar to the second embodiment 170 in that a rotational movement on a ring member 280 causes clamp members 174 to move between the open and closed positions. However, the housing assembly 270 is different in that the clamp members 274 are relatively rigid bodies that do not deflect around the cable sheath 5 and instead rotate about the pins 280*a* and have movement controlled by a slot 272*k* in the front face 272*a* of the housing part 272. As shown, each clamp member 274 includes a main body 274*a* having an arcuate or arc shaped contact surface 274*b* extending between a aperture 274*c* for receiving pin 280*a* and a pin 274*d* which extends into slot 272*k*.

Figure 27:
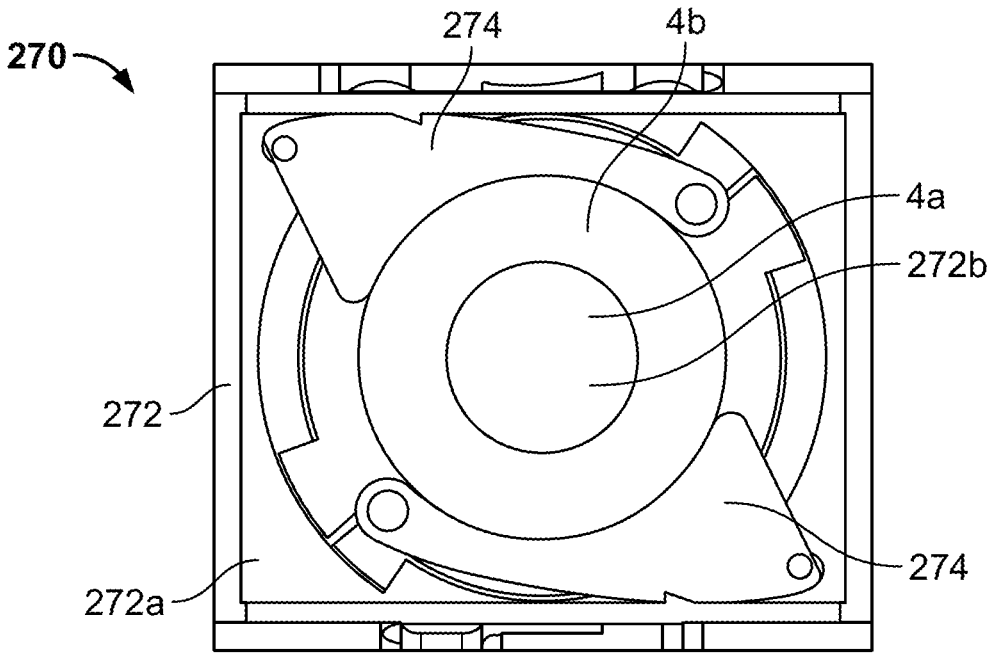
FIG. 27 is a top view of the cable manager part shown in FIG. 26.
Figure 28:
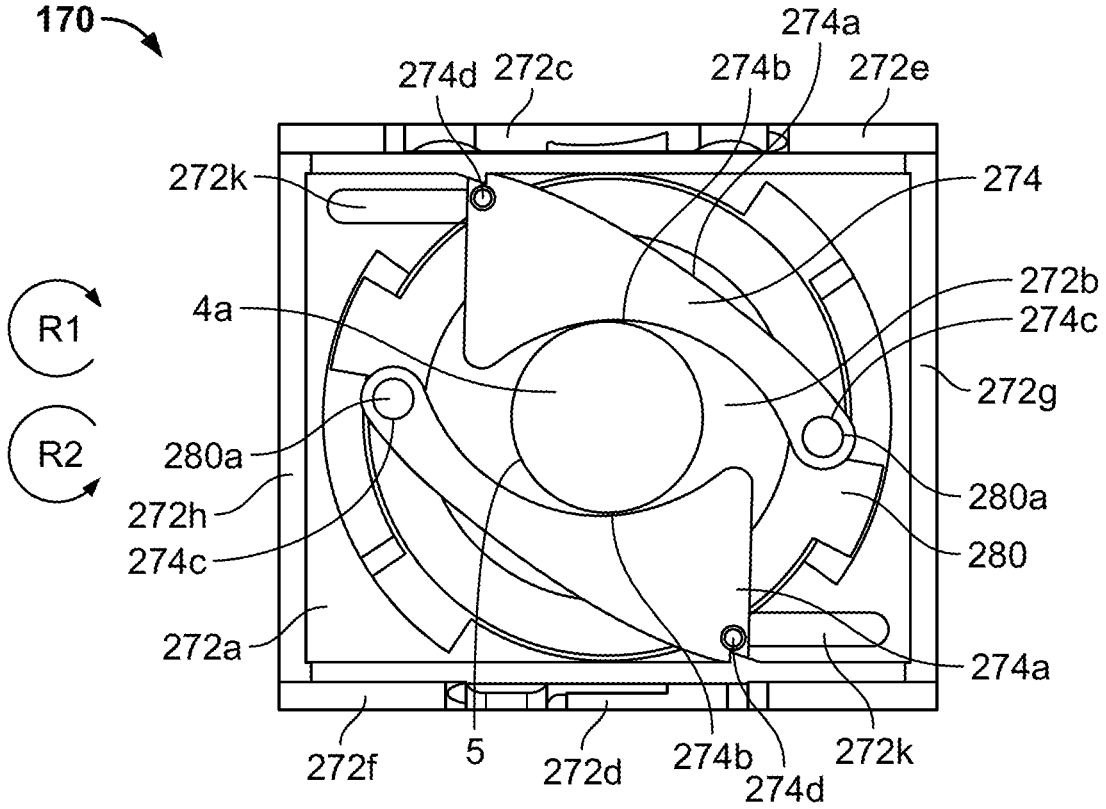
FIG. 28 is a top view of the cable manager part shown in FIG. 26 with the cable manager part in an unclamped position.
Figure 29:
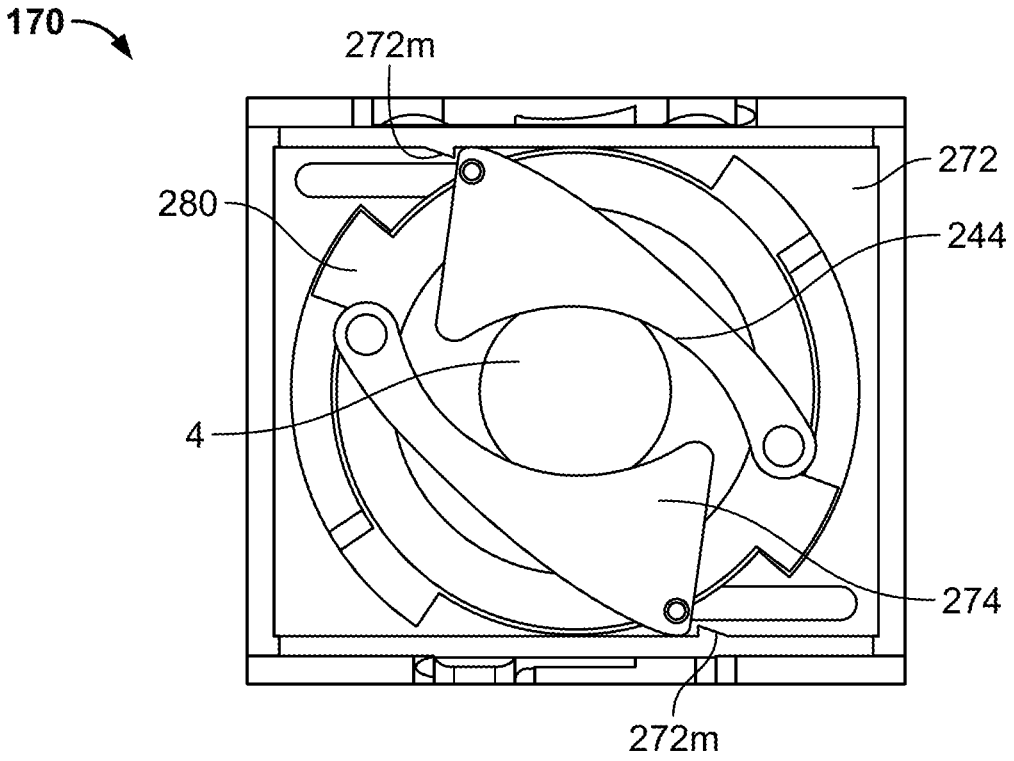
FIG. 29 is a top view of the cable manager part shown in FIG. 26 with the cable manager part in a clamped position.
Figure 30:
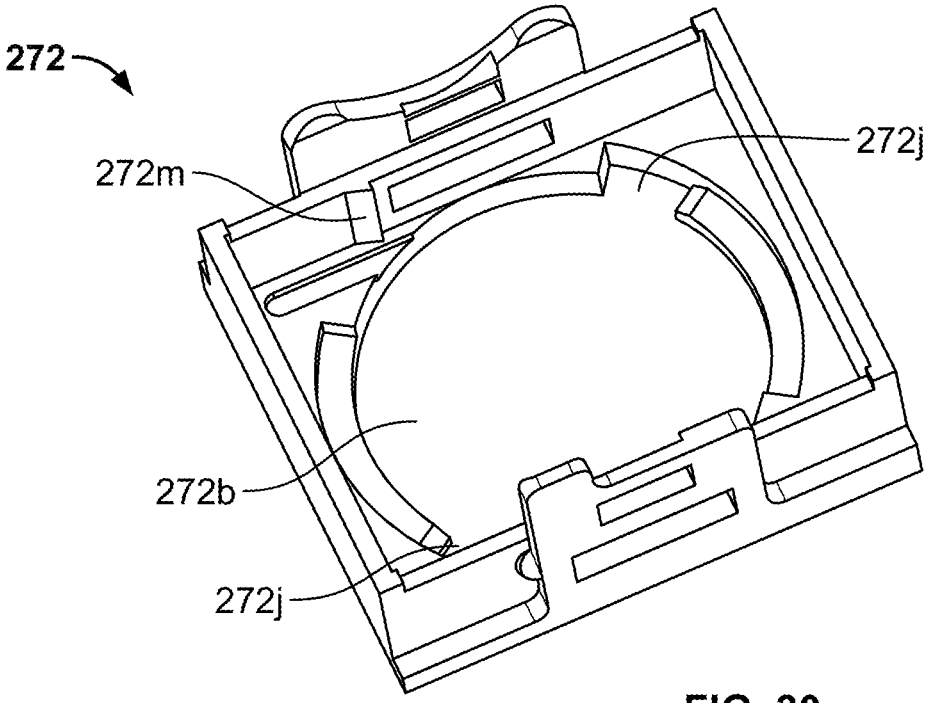
FIG. 30 is a top perspective view of a main body of the cable manager part shown in FIG. 26.
Figure 31:
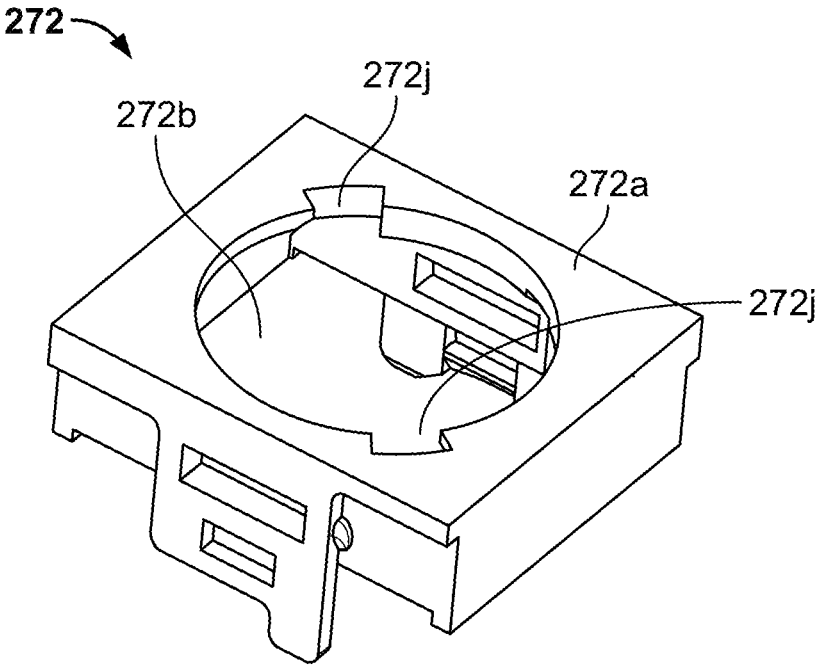
FIG. 31 is a bottom perspective view of the main body shown in FIG. 30.
Figure 32:
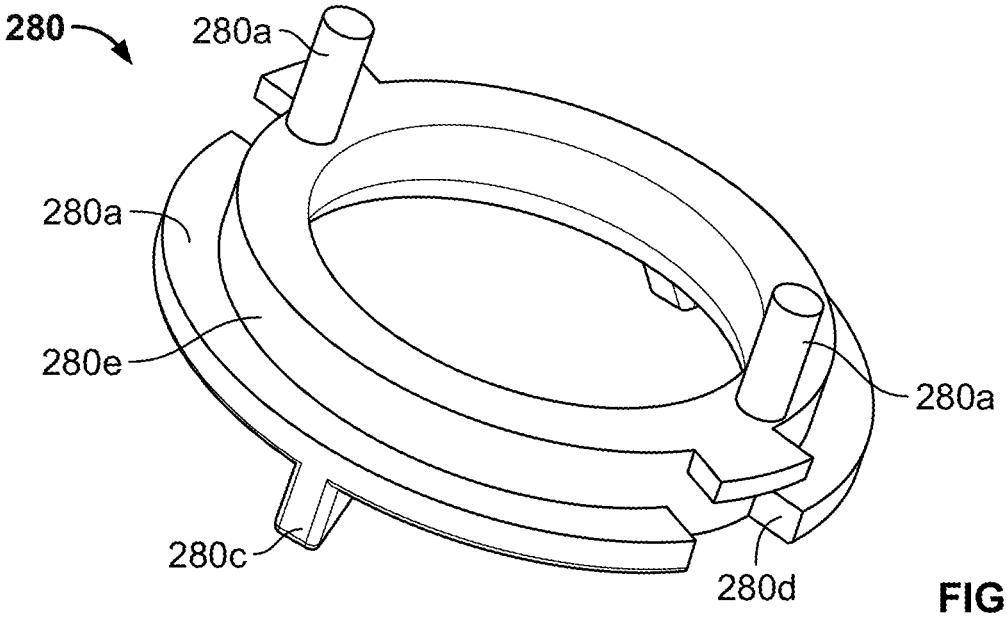
FIG. 32 is a top perspective view of a rotational clamp member of the cable manager part shown in FIG. 26.
Figure 33:
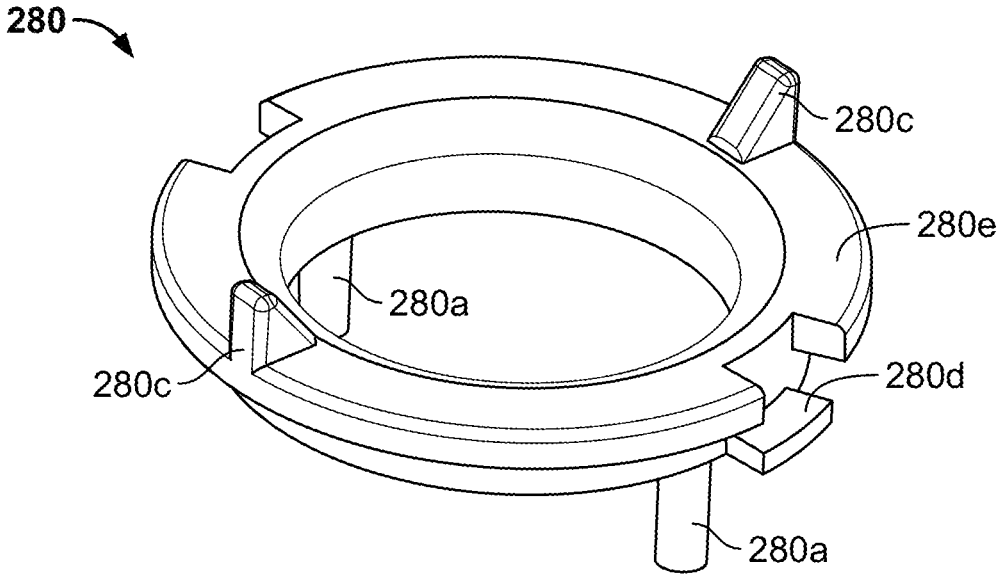
FIG. 33 is a bottom perspective view of the main body shown in FIG. 32.
Figure 34:
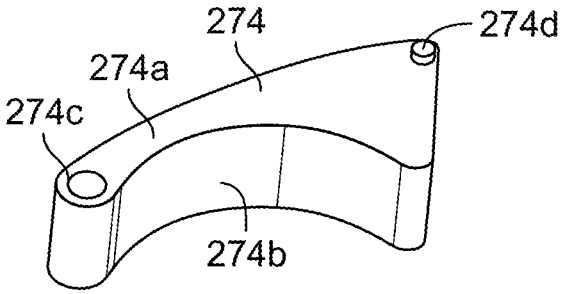
FIG. 34 is a top perspective view of a clamp member of the cable manager part shown in FIG. 26.

As can be seen at FIG. 28, the ring member 280 is rotated into a position such that the clamp members 274 are in a partially opened or clamped position. In this position, the clamp members 274 are sufficiently outside of the area defined by the central aperture 272*b* to allow the smaller cable 4*a* to pass through the central aperture 272*b* but no pressure is applied to the cable 4*a*. The ring member 280 and clamp members 274 are shown in the fully open position at FIG. 27. From this position, the ring member 280 can be rotated in a direction R1 which causes the pins 280*a* to drive the clamp members 274 towards each other and into the area defined by the central aperture 272*b* such that the contact surfaces 274*b* are drawn against the cable sheath 5. During this rotation, the clamp members 274 follow a controlled movement as the pins 274*d* travel along slot 272*k*. Once sufficiently rotated, latch members 272*m* can be provided on the housing part 272 to secure the ends of the clamp members 274, thereby ensuring that the clamp members 274 do not move out of the clamped position without a sufficient rotational force being applied to the ring member 280. In one example, multiple latch members 272*m* are provided for each clamp member 274 such that the clamp members 274 can be ratcheted down onto variously sized cables. A tool, such as a screwdriver, can be inserted to release the clamp members 274 from the latch member 272*m* to which it is locked against. The clamped position is shown at FIG. 27 around the sheath of a larger cable 4*b* and FIG. 29 around the sheath of a smaller cable 4*a*. As most easily seen at FIGS. 30-33, the housing part 272 and ring member 280 are similar to the second embodiment, in that the housing part 272 is provided with notched portions 272*j* and the ring member 280 is provided with handle portions 280*c*, tab portions 280*d*, and a main surface 280*e*.

Referring to the fourth embodiment of a housing assembly 370 presented at FIGS. 35-42, it is noted that this embodiment is similar to the first and second embodiments 70, 170 in that flexible clamp members 374 are placed in a deflected state to ensure clamping against a cable 4. However, rather than sliding the clamp members (e.g. first embodiment 70) or providing a rotating ring member (e.g. second embodiment 170), a rotational force is exerted on the clamp members 374 by operation of a lever arm 380 connected to the first portion 374*c* of the clamp member 374. As with the second embodiment, the clamp members 374 extend between a first end 374*a* and a second end 374*b* with first, second, and third portions 374*c*, 374*d*, 374*e* extending therebetween. The clamp members 374 can also be provided with tab members 374*f*, 374*g* for securing the clamp members 374 to the lever arms 380. A protrusion 380*b* on the lever arm 380 can provide tension within the tab member 374*g* to ensure a secure connection between the lever arm 380 and the clamp member 374.

When assembled, the clamp members 374 are oriented between a pin 372*p* and a backing portion 372*q* of the housing part 372 at the bend location between the first portion 374*c* and the second portion 374*d*. Thus, when the lever arm 380 is rotated about a pin 380*a* received within a slot 372*k* and notch 372*j* of the housing part 372, the second and third portions 374*d*, 374*e* of the clamp members 374 are moved towards each other and into the area defined by the central aperture 372*b* in the front wall 372*a* and against the cable sheath 5. In the clamped position, the lever arms 380 can be received into a cavity 372*m* of the housing part 372. The housing part 372 can be provided with a latch configuration 372*n* for providing a snap-fit type connection with the lever arms 380 to ensure the clamped position is maintained.

Figure 35:
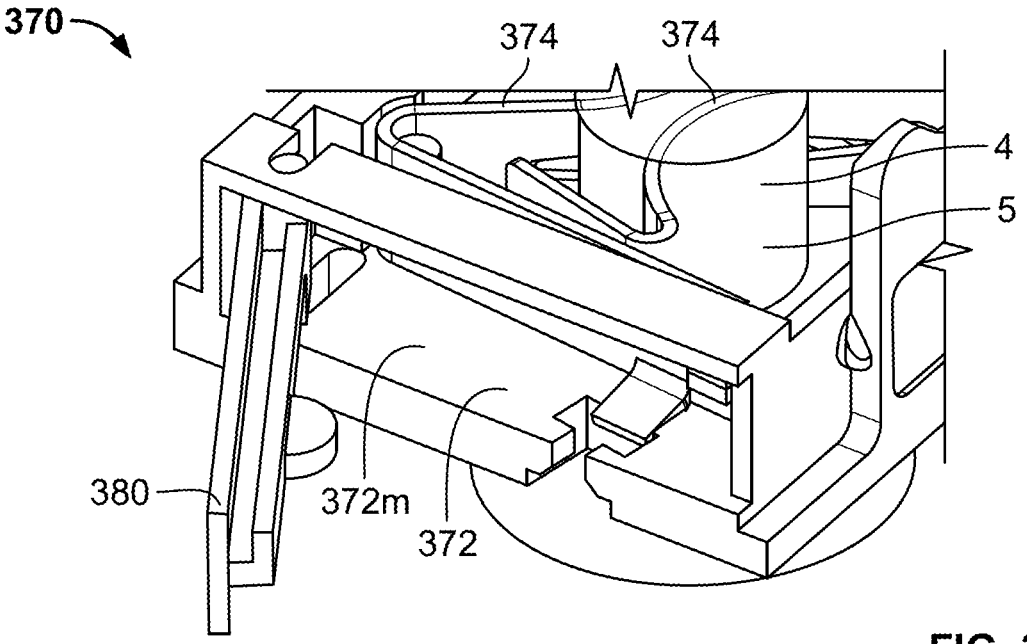
FIG. 35 is a partial top perspective view of a fourth embodiment of a cable manager part for use with the connector part of FIG. 5 having features that are examples of aspects in accordance with the principles of the present disclosure.
Figure 36:
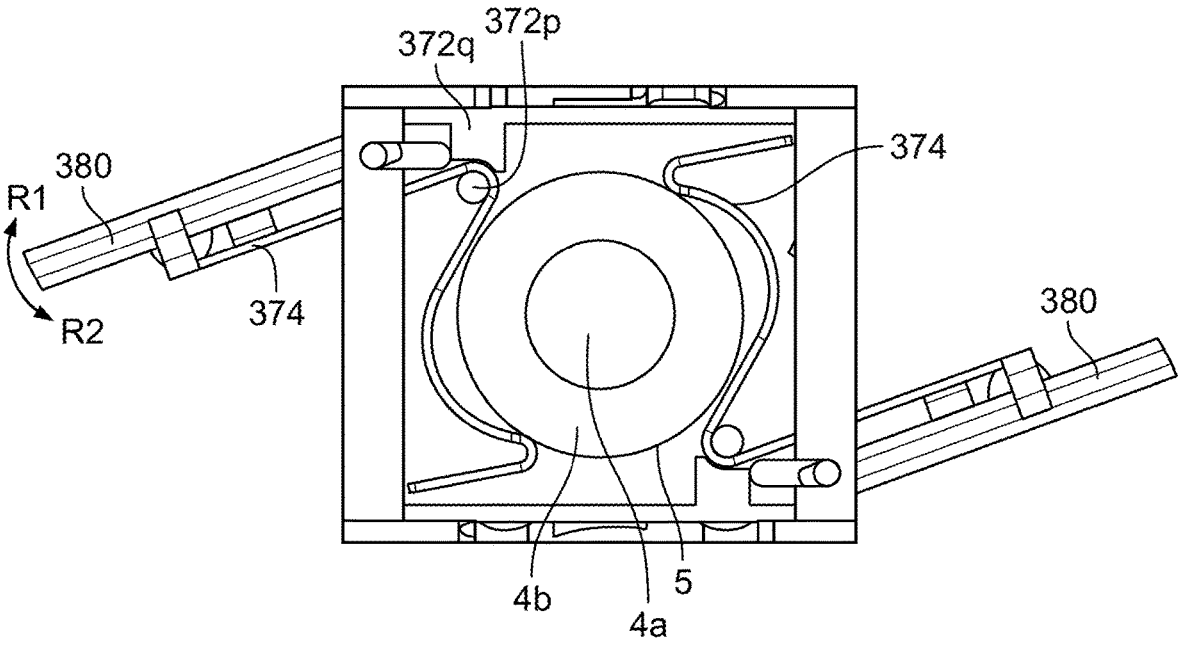
FIG. 36 is a top view of the cable manager part shown in FIG. 35 in an unclamped position.
Figure 37:
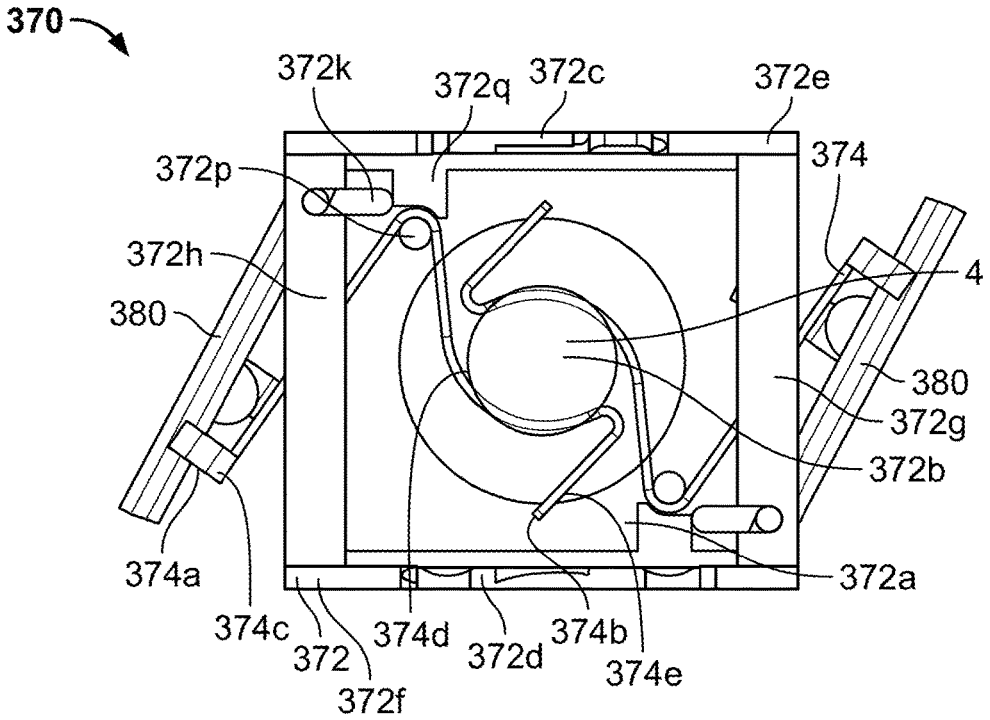
FIG. 37 is a top view of the cable manager part shown in FIG. 35 in a partially clamped position.
Figure 38:
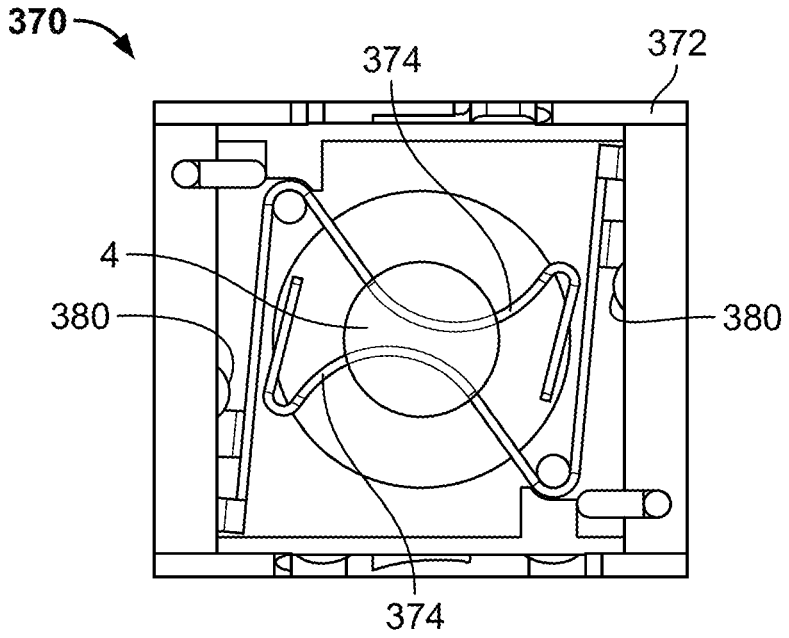
FIG. 38 is a top view of the cable manager part shown in FIG. 35 in a clamped position.
Figure 39:
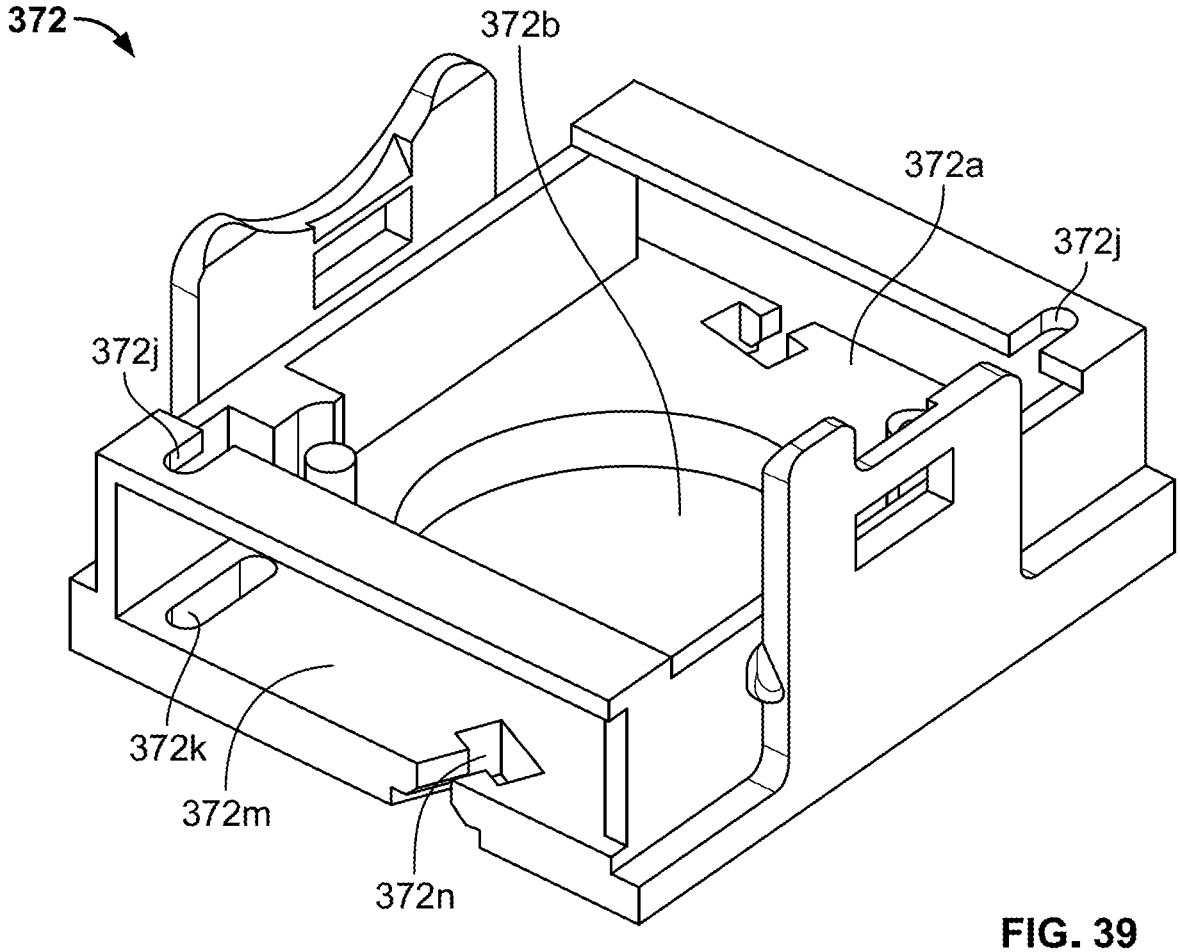
FIG. 39 is a top perspective view of a main body of the cable manager part shown in FIG. 35.
Figure 40:
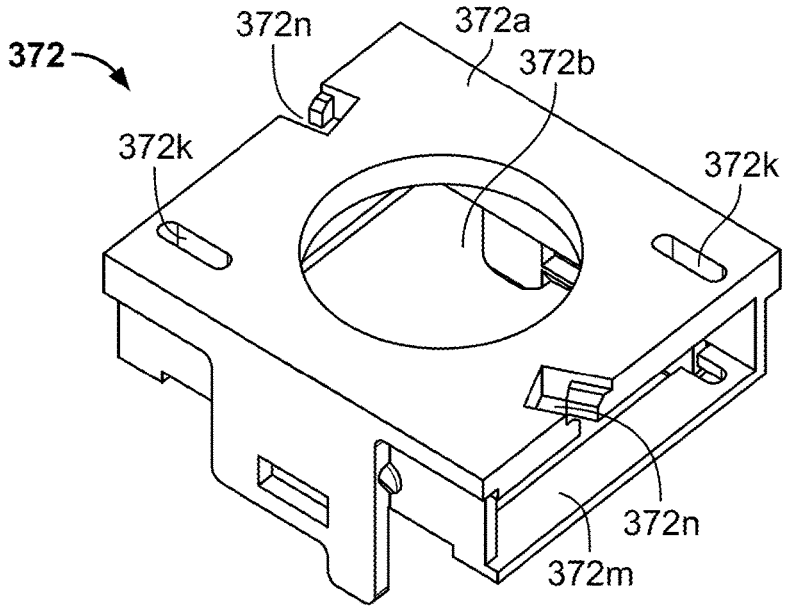
FIG. 40 is a bottom perspective view of a main body of the cable manager part shown in FIG. 35.
Figure 41:
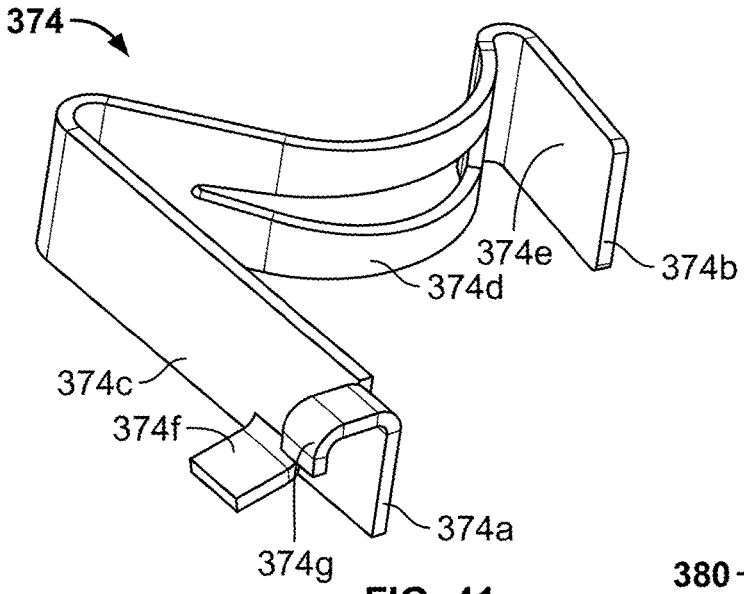
FIG. 41 is a top perspective view of a clamp member of the cable manager part shown in FIG. 35.
Figure 42:
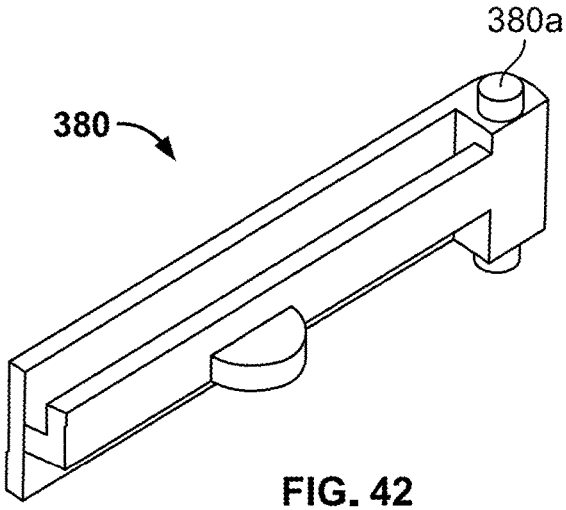
FIG. 42 is a top perspective view of a clamp arm of the cable manager part shown in FIG. 35.

FIGS. 35 and 36 show the housing assembly 370 in the open position, FIG. 37 shows the housing assembly 370 in a partially closed position, and FIG. 38 shows the housing assembly 370 in the clamped position (however, not showing deflection that would occur around cable 4).

For each of the disclosed embodiments 70, 170, 270, 370, a wide range of cable diameters can be accommodated, for example cables ranging between 4 millimeters to 9 millimeters can be accepted and grounded by the same clamp assembly.

Many materials can be suitable closed for the components of the disclosed embodiments clamp members 70, 170, 270, 370. For example, the clamp members 74, 174, 274, 374 can be formed from a metal material, such as plated copper alloy, stainless steel, and/or zinc die-casting. The clamp member 274 is particularly well suited to formation via die-casting.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the disclosure.

PARTS LIST

2 terminated connector and cable
4 cable
5 conductive element/sheath
6 wires or filaments
10 connector assembly
12 connector part
12*a* first side
12*b* second side
14 jack cavity
16 electrical conductors
18 cutting edges
20 cable manager part
30 lacing structure
70 housing assembly
72 first housing part main body
72*a* end wall
72*b* central aperture
72*c* sidewalls

72*d* sidewalls
72*e* sidewalls
72*f* sidewalls
72*g* sidewalls
72*k* interior sidewalls
72*m* interior sidewalls
72*n* latch members
72*p* latch members
72*r* protrusions
72*s* protrusions
72*t* apertures
72*v* apertures
72*x* channel
72*y* channel
74 clamp member
74*a* first end
74*b* second end
74*c* handle portion
74*d* slide portion
74*e* bend portion
74*f* clamp portion
74*g* end portion
74*h* notch
74*i* aperture
170 housing assembly
172 first housing part main body
172*a* front face or front wall
172*b* central aperture
172*c* sidewall
172*d* sidewall
172*e* sidewall
172*f* sidewalls
172*g* sidewalls
172*h* sidewalls
172*j* notch
174 clamp member
174*a* first end
174*b* second end
174*c* first portion
174*d* second portion
174*e* third portion
174*f* tab portion
180 ring member
180*a* pin
180*b* handle
180*d* tab portion
180*e* main surface
270 housing assembly
272 housing part
272*a* front face or front wall
272*b* central aperture
272*c* sidewall
272*d* sidewall
272*e* sidewall
272*f* sidewall
272*g* sidewall
272*h* sidewall
272*j* notched portion
272*k* slot
272*m* latch member
274 clamp member
274*a* main body
274*b* contact surface
274*c* aperture
274*d* pin
280 ring member
280*a* pin
280*c* handle portion
280*d* tab portions
280*e* main surface
370 housing assembly
372*a* front face or front wall
372*b* central aperture
372*c* sidewall
372*d* sidewall
372*e* sidewall
372*f* sidewall
372*g* sidewall
372*h* sidewall
372*j* notch
372*k* slot
372*m* cavity
372*n* latch configuration
372*p* pin
372*q* backing portion
374 clamp member
374*a* first end
374*b* second end
374*c* first portion
374*d* second portion
374*e* third portion
374*f* tab members
374*g* tab member
380 lever arm
380*a* pin
380*b* protrusion

What is claimed is:

1. A connector assembly comprising:

a) a connector part having a jack cavity;

b) a cable manager part conductively attached to the connector part, the cable manager part having:

i) a housing assembly having a housing part defining a central aperture through which a cable having an exposed conductive element can extend;

ii) a grounding clamp assembly held within the housing part, the grounding clamp assembly including a first clamp member and an oppositely arranged second clamp member, the first and second clamp members being movable between an open position and a clamped position:

1) in the open position, the clamp members being disposed away from the central aperture and being in a relaxed state;

2) in the clamped position, the clamp members extending across the central aperture and contacting the conductive element of an inserted cable by bending around the conductive element in a deflected state;

c) wherein the clamp members have a handle portion for grasping the clamp members.

2. The connector assembly of claim 1, wherein the clamp members are moved between the open and clamped position by displacing the clamp members in a linear direction.

3. The connector assembly of claim 1, wherein the clamp members are formed from a metal material.

4. The connector assembly of claim 1, wherein the clamp members include an aperture for increasing the flexibility of the clamp members.

5. A connector assembly comprising:

a) a connector part having a jack cavity;

b) a cable manager part conductively attached to the connector part, the cable manager part having:

i) a housing assembly having a housing part defining a central aperture through which a cable having an exposed conductive element can extend;

ii) a grounding clamp assembly held within the housing part, the grounding clamp assembly including a first clamp member and an oppositely arranged second clamp member, the first and second clamp members being movable between an open position and a clamped position:

1) in the open position, the clamp members being disposed away from the central aperture and being in a relaxed state;

2) in the clamped position, the clamp members extending across the central aperture and contacting the conductive element of an inserted cable by one or both of bending around the conductive element in a deflected state and rotating against the conductive element;

c) wherein the grounding cable manager part further includes a ring member rotatably disposed within the first housing part, the ring member being rotatable to move the clamp members between the open and clamped positions.

6. The connector assembly of claim 5, wherein the ring member includes at least one handle member for manipulating the ring member.

7. The connector assembly of claim 5, wherein each clamp member is a rigid body.

8. The connector assembly of claim 5, wherein the ring member includes a pair of posts for engaging with the clamp members.

9. A connector assembly comprising:

a) a connector part having a jack cavity;

b) a cable manager part conductively attached to the connector part, the cable manager part having:

i) a housing assembly having a housing part defining a central aperture through which a cable having an exposed conductive element can extend;

ii) a grounding clamp assembly held within the housing part, the grounding clamp assembly including a first clamp member and an oppositely arranged second clamp member, the first and second clamp members being movable between an open position and a clamped position:

1) in the open position, the clamp members being disposed away from the central aperture and being in a relaxed state;

2) in the clamped position, the clamp members extending across the central aperture and contacting the conductive element of an inserted cable by one or both of bending around the conductive element in a deflected state and rotating against the conductive element;

c) wherein the grounding cable manager part includes a pair of lever arms engaged with the clamp members.

10. The connector assembly of claim 9, wherein the lever arms are rotatable to move the clamp members between the open and clamped positions.

11. The connector assembly of claim 10, wherein the lever arms are received within cavities of the housing part when the clamp members are in the clamped position.

12. A connector assembly comprising:

a) a connector part having a jack cavity;

b) a cable manager part conductively attached to the connector part, the cable manager part having:

i) a housing assembly having a housing part defining a central aperture through which a cable having an exposed conductive element can extend;

ii) a grounding clamp assembly held within the housing part, the grounding clamp assembly including a first clamp member and an oppositely arranged second clamp member, the first and second clamp members being movable between an open position and a clamped position:

1) in the open position, the clamp members being disposed away from the central aperture and being in a relaxed state;

2) in the clamped position, the clamp members extending across the central aperture and contacting the conductive element of an inserted cable by rotating against the conductive element.

13. The connector assembly of claim 12, wherein the grounding cable manager part further includes a ring member rotatably disposed within the first housing part, the ring member being rotatable to move the clamp members between the open and clamped positions.

14. The connector assembly of claim 13, wherein the ring member includes at least one handle member for manipulating the ring member.

15. The connector assembly of claim 13, wherein each clamp member is a rigid body.

* * * * *